US006205304B1

(12) United States Patent
Kawaguchi

(10) Patent No.: US 6,205,304 B1
(45) Date of Patent: Mar. 20, 2001

(54) DEVELOPING APPARATUS

(75) Inventor: Hideshi Kawaguchi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/426,773

(22) Filed: Oct. 26, 1999

(30) Foreign Application Priority Data

Oct. 28, 1998 (JP) ..... 10-307120

(51) Int. Cl.[7] ..... G03G 15/06
(52) U.S. Cl. ..... 399/103; 399/273; 399/283
(58) Field of Search ..... 399/102, 103, 399/104, 105, 111, 267, 273, 283, 274, 284

(56) References Cited

U.S. PATENT DOCUMENTS 5,084,733 * 1/1992 Katoh et al. ..... 399/104
5,655,178 * 8/1997 Ishikawa et al. ..... 399/102
5,895,144 * 4/1999 Nishimura ..... 399/104

FOREIGN PATENT DOCUMENTS 6-011958 * 1/1994 (JP) .

* cited by examiner

*Primary Examiner*—Sophia S. Chen
(74) *Attorney, Agent, or Firm*—Fitzpatrick, Cella, Harper & Scinto

(57) ABSTRACT

The present invention relates to a developing apparatus which has a developer bearing member, a sealing member, a developer scraping portion, and a damming portion disposed on the downstream side of the sealing members and on an upstream side of the developer scraping portion in the carrying direction, and adapted for damming the developer scraped off by the developer scraping portion, and a damming surface of the damming portion is provided so as to intersect with the developer scraping portion.

20 Claims, 9 Drawing Sheets

DEVELOPING APPARATUS

BACKGROUND OF THE INVENTION

1. Field of the Invention

The present invention relates to a developing apparatus that develops an electrostatic image on an image bearing member, and more particularly to a developing apparatus preferably applied to an image forming apparatus such as a copier or a printer of the electrophotographic system, or a process cartridge detachably attachable to the image forming apparatus.

2. Related Background Art

Up to now, as a developing apparatus for use in an electrophotographic image forming apparatus such as a printer or a copier, as shown in FIG. 9, there has been proposed a developing apparatus having a process cartridge B detachably attachable to a main body of the electrophotographic image forming apparatus. Referring to FIG. 9, in the developing apparatus of this type, a magnet Mg is disposed within a hollow cylindrical developing roller 60*c* that functions as a developer bearing member, and its magnetic force allows a developer (hereinafter referred to as "toner") to be attracted onto the developing roller 60*c*. Then, with the rotation of the developing roller 60*c* (or the magnet Mg), the toner is carried to a developing section that allows a latent image to be visualized.

As a manner of preventing the toner from being leaked outward from a developing container 60*b*, there has been known a method in which a sealing member such as a felt is brought into contact with the developing roller outside of an image region, or as shown in FIG. 9, a ferromagnetic member 71 that functions as a sealing member is disposed out of contact with the developing roller 60*c* so that its magnetic force allows the toner to be held.

In addition, in order that the toner carried on the downstream side of the sealing member with the rotation of the developing roller 60*c* or the magnet Mg as described above is again returned within the developing region so as to be prevented from being leaked outwardly, a scraping member 72 is disposed on the downstream side of the above-described sealing member (the ferromagnetic member 71 in FIG. 9) in a direction along which the developing roller 60*c* rotates, and a part of the scraping member 72 is brought into contact with the developing roller 60*c*.

Also, in order to hold a distance between a photosensitive drum 57 and the developing roller 60*c* constant, there is applied a method in which both end portions of the developing roller 60*c* are covered with cap rollers (not shown) the thickness of which is severely managed.

However, in the above-described conventional example, there was a case in which when the toner scraped off by the scraping member 72 is over-deposited on the scraping member 72, the toner comes off from the developing roller 60*c* and flies up with the result that the toner is temporarily or permanently dispersed and exists in the form of a lump on a portion where the photosensitive drum 57 and the cap rollers are abutted against each other. In this case, when the rotation of the photosensitive drum 57 or the developing roller 60*c* permits a lump of the toner to come to a position where the photosensitive drum 57 and the cap rollers are in contact with each other, a distance between the photosensitive drum 57 and the developing roller 60*c* becomes rapidly larger than a given distance (the thickness of the cap rollers), thereby causing a case in which the distance made larger returns to the given distance after the lump of toner has passed between the photosensitive drum 57 and the developing roller 60*c*. This leads to a phenomenon (hereinafter referred to as "white banding") in which an image on a portion corresponding to the lump of toner is thinned.

SUMMARY OF THE INVENTION

An object of the present invention is to provide a developing apparatus that regulates the amount of developer which is deposited on a developer scraping member.

Another object of the present invention is to provide a developing apparatus that restrains the developer scraped off by the developer scraping member from coming off from a developer bearing member and flying up.

Still another object of the present invention is to provide a developing apparatus that prevents the above white banding from occurring or delays the occurrence of the white banding for a long period of time.

Yet still another object of the present invention is to provide a developing apparatus that reduces the amount of developer leaked from the developer scraping member.

Other objects and features of the present invention will become apparent by reading the following detailed description with reference to the accompanying drawings.

DESCRIPTION OF THE PREFERRED EMBODIMENTS

Hereinafter, a description will be given in more detail of embodiments of an image forming apparatus to which a process cartridge having a developing apparatus according to the present invention is detachably attachable with reference to the accompanying drawings.

(First Embodiment)

Referring to FIGS. 1 to 4 and 8, a first embodiment of an image forming apparatus to which a process cartridge having a developing apparatus according to the present invention is detachably attachable will be described in detail.

Figure 1:
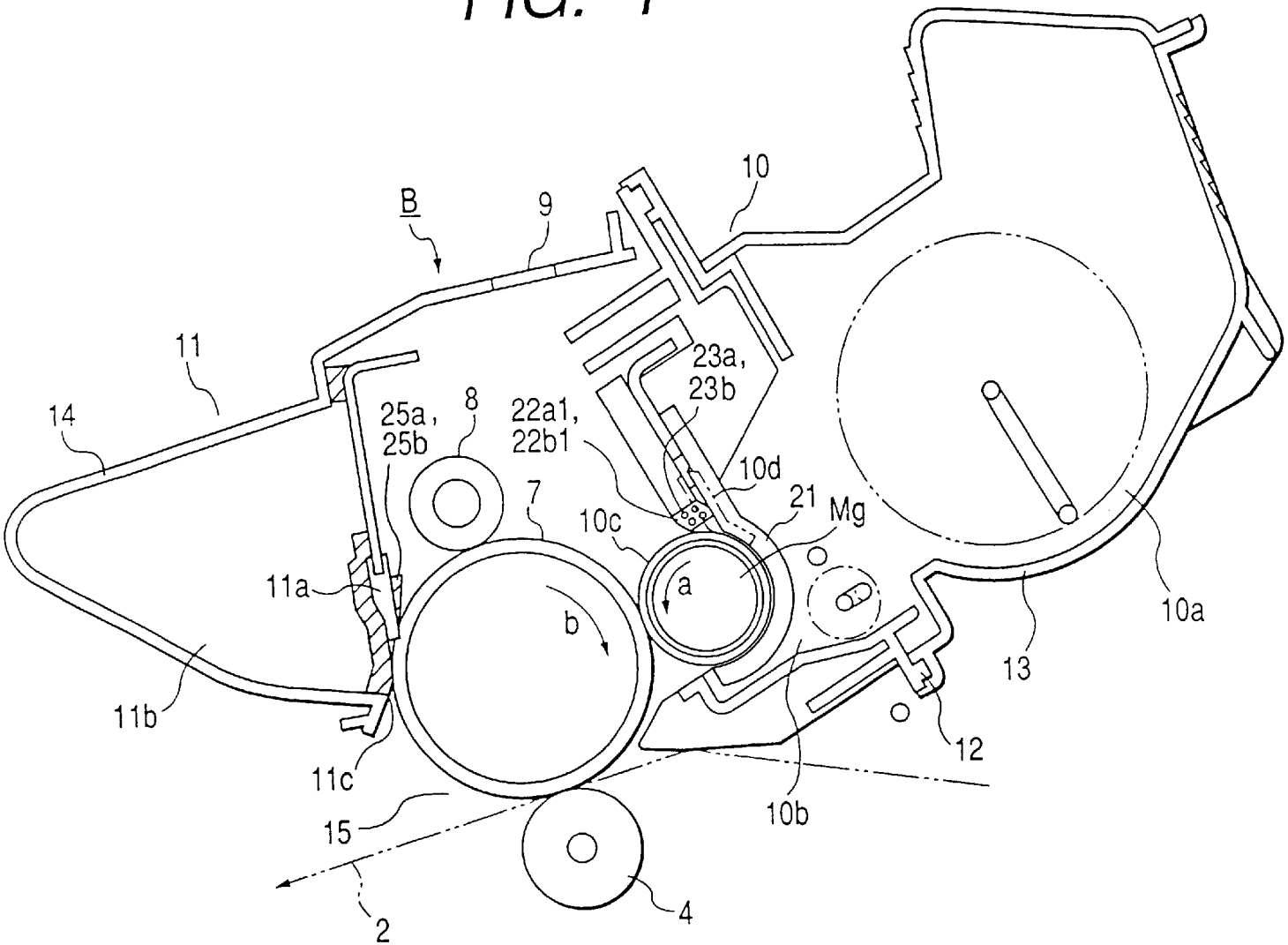
FIG. 1 is a schematic cross-sectional view showing the structure of a main portion of a process cartridge having a developing apparatus in accordance with a first embodiment of the present invention.
Figure 2:
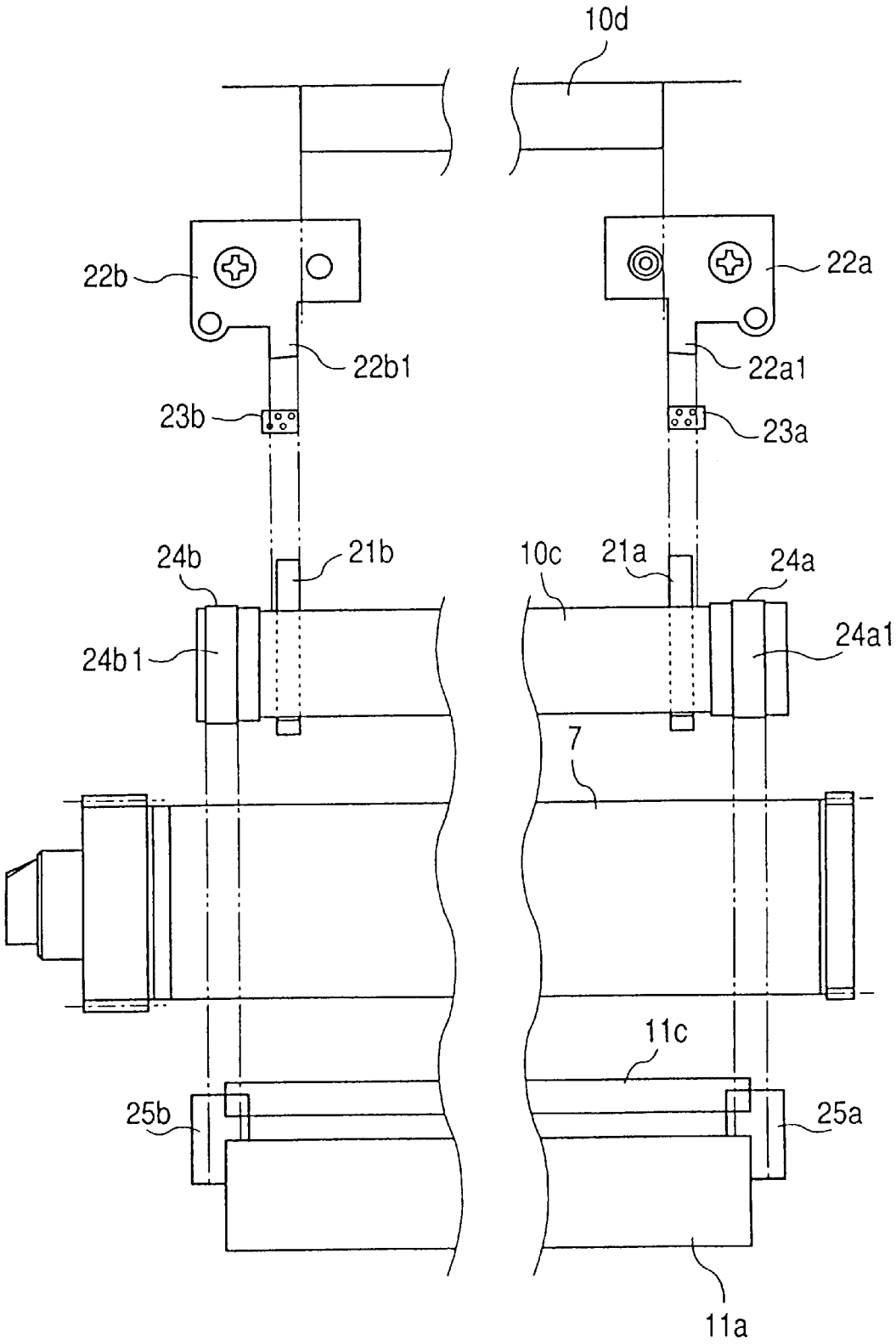
FIG. 2 is a diagram showing a longitudinally positional relationship between process parts and related parts of the developing apparatus in accordance with the first embodiment.
Figure 3:
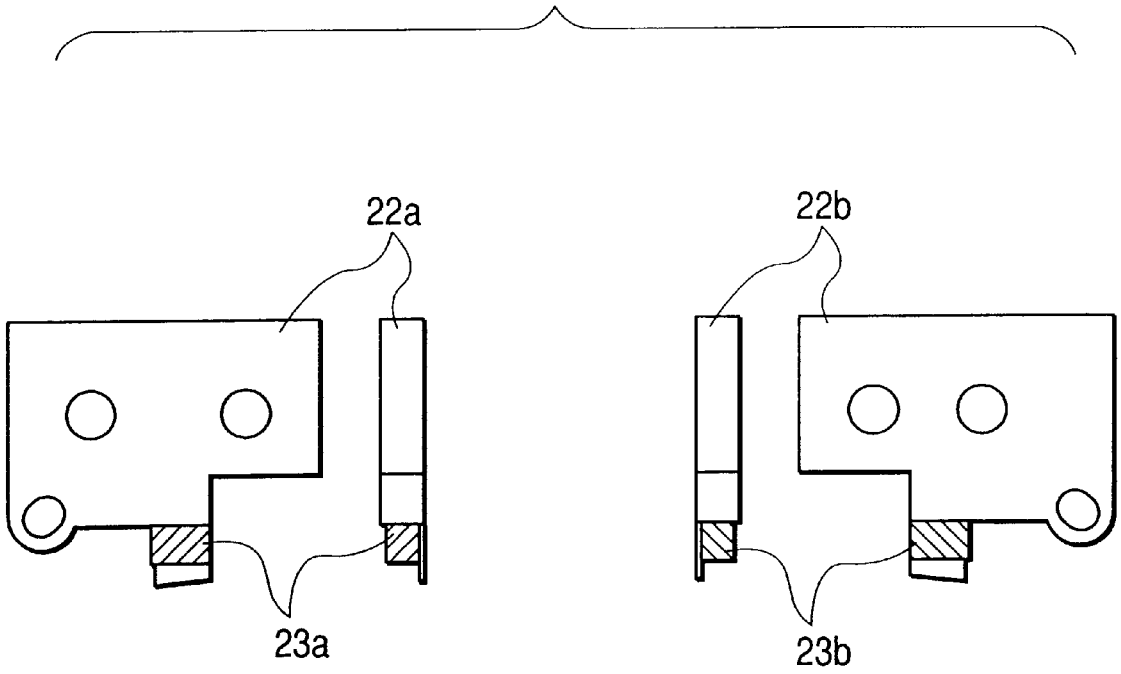
FIG. 3 is a view showing a position at which a damming member is fitted onto a scraping member in accordance with the first embodiment, viewed from two directions.
Figure 4:
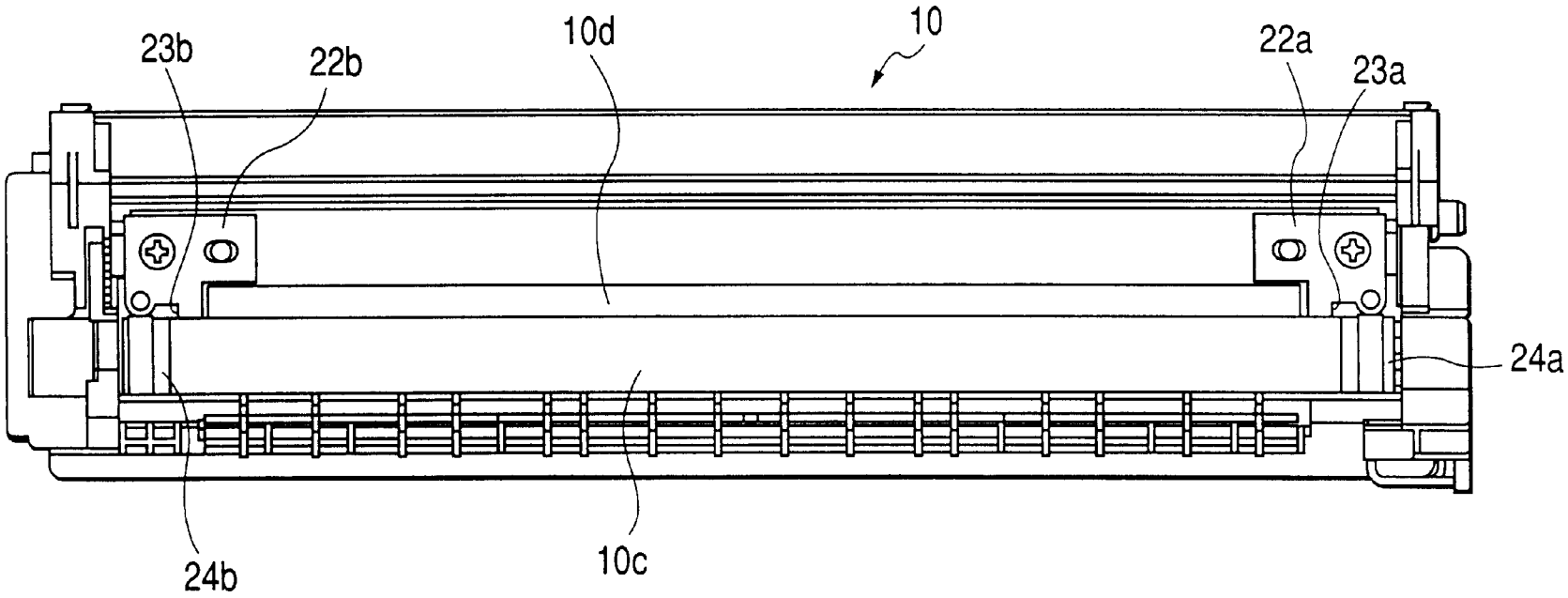
FIG. 4 is a diagram showing an appearance of the developing apparatus in accordance with the first embodiment, viewed from an electrophotographic photosensitive member side.
Figure 8:
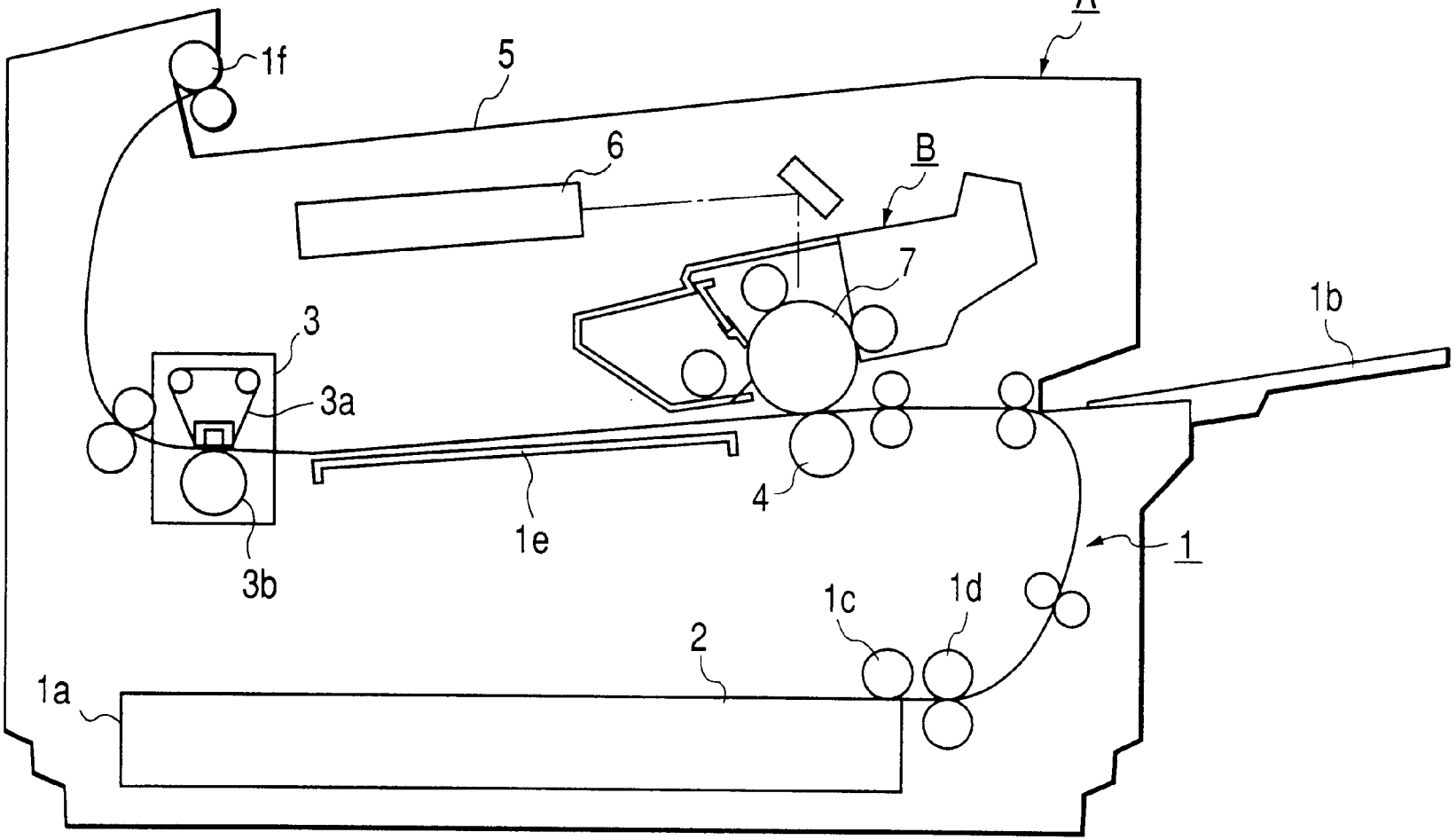
FIG. 8 is a schematic cross-sectional view showing an image forming apparatus to which a process cartridge having the developing apparatus according to the present invention is detachably attachable.
Figure 9:
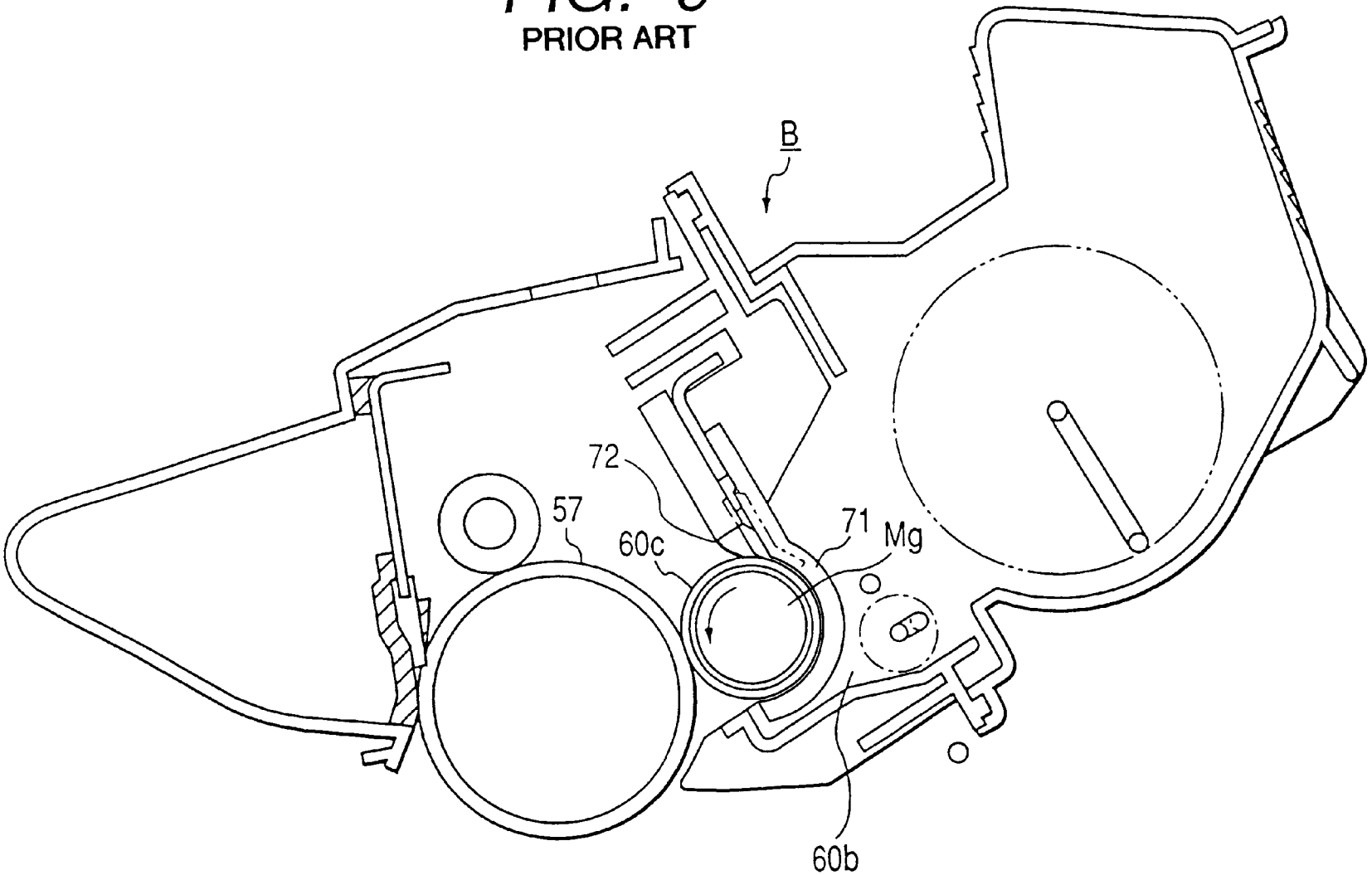
FIG. 9 PRIOR ART
FIG. 9 is a schematic cross-sectional view showing a main portion of a conventional example.

FIG. 1 is a main schematic cross-sectional view showing a process cartridge having a developing apparatus in accordance with a first embodiment of the present invention, FIG. 2 is a diagram showing a longitudinally positional relationship between process parts and related parts of the developing apparatus, FIG. 3 is a view showing a position at which a damming member is fitted onto a scraping member, viewed from two directions, and FIG. 4 is a diagram showing an appearance of the developing apparatus, viewed from an electrophotographic photosensitive member side. Also, FIG. 8 is a schematic cross-sectional view showing an image forming apparatus to which the process cartridge having the developing apparatus is detachably attachable. In the following description, terms "longitudinally" and "longitudinal direction" indicate an axial direction of a rotating center shaft of a developing roller.

(Entire Structure of an Image Forming Apparatus)

As shown in FIG. 8, an image forming apparatus A is designed to form an image on a recording medium through an electrophotographic image forming process in the following manner. That is, a toner image is formed on a drum-shaped electrophotographic photosensitive member (hereinafter referred to as "photosensitive drum") which functions as an image bearing member. A recording medium 2 set on a sheet feed cassette 1*a* or a sheet feed tray 1*b* is selectively conveyed by conveying means 1 made up of a pickup roller 1*c*, a sheet feed roller 1*d* and so on, in synchronism with the formation of the toner image. Subsequently, the toner image formed on a photosensitive drum 7 provided in a process cartridge B is transferred onto the recording medium 2 by application of a voltage to a transfer roller 4 that functions as transferring means. Thereafter, the recording medium 2 onto which the toner image has been transferred is conveyed to a fixing means 3 while being guided by a guide plate 1*e*. The fixing means 3 is made up of a fixing rotary member 3*a* in which a heater is installed and a pressurizing roller 3*b* that conveys the recording medium 2 while pressurizing the recording medium 2 on the fixing rotary member 3*a*. With the fixing means 3 thus structured, a heat and a pressure are applied to the recording medium 2 to fix a transfer toner image onto the recording medium 2. Finally, the recording medium 2 is conveyed by a discharge roller if so as to be discharged toward a discharge section 5.

(Process Cartridge)

A process cartridge B is designed, as shown in FIG. 1, such that the photosensitive drum 7 having a photosensitive layer that functions as an image bearing member is permitted to rotate, and a surface of the photosensitive drum 7 is uniformly charged by application of a voltage from a charging roller 8 that functions as charging means. Then, light from a laser beam source 6 is irradiated onto the photosensitive drum 7 through an expose opening portion 9 to form an electrostatic latent image and develop with a magnetic toner that functions as developer by developing means 10. That is, the charging roller 8 is disposed in contact with the photosensitive drum 7 to charge the photosensitive drum 7. Also, developing means 10 develops a latent image formed on the photosensitive drum 7 by supplying toner to a developing region of the photosensitive drum 7.

The developing means 10 supplies the toner within a toner container 10*a* to a developing container 10*b*, and while a developing roller 10*c* fitted to the developing container 10*b* is permitted to rotate, a toner layer to which a frictionally electrified charge is given is formed on a surface of the developing roller 10*c* that functions as a developer bearing member, into which a magnet (stationary magnet) Mg is fitted, by a developing blade 10*d* that functions as a regulating member for regulating the thickness of a developer on the developer bearing member. The toner is then supplied to the developing region (image region) of the photosensitive drum 7. Thereafter, the toner is carried onto the photosensitive drum 7 in correspondence with the latent image, to thereby form and visualize the toner image.

After the toner image formed on the photosensitive drum 7 is transferred onto the recording medium 2 with application of a voltage reverse in polarity to the toner image to the transfer roller 4, residual toner on the photosensitive drum 7 is removed by cleaning means 11. In this cleaning means 11, the residual toner on the photosensitive drum 7 is scraped off by a cleaning blade 11*a* and then collected into a waste toner reservoir 11*b*.

The respective parts of the photosensitive drum 7 and so on are received within a cartridge frame member structured by combining a toner developing frame member 12, a toner developing wall member 13 and a cleaning frame member 14 together to provide a cartridge. In other words, the toner developing frame member 12 and the toner developing wall member 13 are welded to constitute the toner container 10*a* and the developing container 10*b*, and the developing container 10*b* is fitted with the developing roller 10*c* and the developing blade 10*d*. Also, the cleaning frame member 14 is fitted with the respective parts that constitute the photosensitive drum 7, the charging roller 8 and the cleaning means 11. In addition to the above structure, the toner developing frame member 12 and the cleaning frame member 14 are swingably coupled to each other, to thereby constitute the process cartridge B.

Defined in the process cartridge B are an exposure opening portion 9 through which a light is irradiated onto the photosensitive drum 7 in correspondence with image information, and a transfer opening portion 15 where the photosensitive drum 7 is opposed to the recording medium 2. Both the opening portions 9 and 15 are fitted with openable/closeable shutter members (not shown). That is, the transfer opening portion 15 is so designed as to transfer the toner image formed on the photosensitive drum 7 onto the recording medium 2.

(Structure of Periphery of Sealing of the Developing Means)

Subsequently, a description will be given in detail of the structure of the periphery of sealing of the developing means 10, in particular, end portions thereof. In FIG. 4, there are shown the developing roller 10*c*, the developing blade 10*d*, scrapers 22*a* and 22*b* that function as a developer scraping member, and cap rollers 24*a* and 24*b* that function as the gap regulating member, which cover both end portions of the developing roller 10*c* and hold a gap between the photosensitive drum 7 and the developing roller 10*c* constant. On the other hand, a magnetic sealing member 21 is never shown in the figure because it is hidden by the scrapers 22*a* and 22*b* and the developing roller 10*c*, and damming members 23*a* and 23*b* are slightly shown since they are hidden at the back of the scrapers 22*a* and 22*b*.

First, the basic structure of a seal will be described. In order to prevent the toner from being leaked outward from the developing container 10*b*, as shown in FIG. 1, a magnetic sealing member 21*a*, 21*b* which functions as the sealing member and is formed of a ferromagnetic substance (about 2000 G (gauss) on its surface), is disposed out of contact with and in the vicinity of the developing roller 10*c*, outside of the developing blade 10*d* in a longitudinal direction of the developing roller 10*c* as shown in FIG. 2. A magnetic force of the magnetic sealing member 21*a*, 21*b* allows the toner to be held in the gap portion between the developing blade 10*d* and the developing roller 10*c*, to thereby prevent the toner within the developing container 10*b* from being leaked outward therefrom through the gap portion. In addition, in order to return the toner coming out of the above-described gap portion due to the rotation of the developing roller 10*c* again to the developing region to prevent the toner from being leaked outward, as shown in FIG. 1, the scrapers 22*a* and 22*b* that function as the scraping member are disposed on the downstream side of the magnetic sealing member 21 along the rotating direction of the developing roller 10*c* (a direction indicated by an arrow a in FIG. 1), and the scrapers 22*a* and 22*b* are partially brought into contact with the developing roller 10*c*.

In other words, as shown in FIG. 2, the scrapers 22*a* and 22*b* are so disposed as to be overlapped with the magnetic sealing member 21*a*, 21*b* in the longitudinal direction and extend up to the outside of the magnetic sealing member 21. Those scrapers 22*a* and 22*b* scrape the toner that has passed through the gap portion between the developing roller 10*c* and the magnetic sealing member 21 due to the rotation of the developing roller 10*c* from the surface of the developing roller 10*c* before the toner reaches the developing section between the developing roller 10*c* and the photosensitive drum 7. Moreover, the abutting portions of the scrapers 22*a* and 22*b* against the developing roller 10*c* (scraping portions 22*al* and 22*bl*) are so shaped as to be in contact with each other on more downstream side along the rotating direction of the developing roller 10*c* toward the image region side (inside) in the longitudinal direction of the developing roller 10*c*, that is, so shaped as to direct the scraped toner toward the inside (image region side) in the longitudinal direction due to the rotation of the developing roller 10*c*, as shown in FIG. 2.

The scrapers 22*a* and 22*b* are abutted against the roller 10 in a counter direction to the rotating direction of the developing roller 10*c* as shown in FIG. 1.

The damming members 23*a* and 23*b* made of polyurethane foam or the like, as shown in FIGS. 1 and 3, are disposed in the vicinity of the abutting portions of the scrapers 22*a* and 22*b* against the developing roller 10*c* and on an opposite side of the abutting surfaces of the scrapers 22*a* and 22*b* against the developing roller 10*c*. The damming members 23*a* and 23*b* are bent within the configurations of the scrapers 22*a* and 22*b* and are in contact with portions actually related to scraping (scraping portions 22*al* and 22*bl*). The damming members 23*a* and 23*b* are in contact with the scraping portions 22*al* and 22*bl* of the respective scrapers 22*a* and 22*b* in bent states to ensure contact. However, since the damming members 23*a* and 23*b* are made of a soft material such as polyurethane foam, they hardly influence the pressurizing force of the scraping portions 22*al* and 22*bl* of the scrapers 22*a* and 22*b* to the developing roller 10*c*.

In the above structure, the toner scraped off by the scrapers 22*a* and 22*b* are reserved on the scraping portions 22*al* and 22*bl* of the scrapers 22*a* and 22*b*. However, since the above-described damming members 23*a* and 23*b* are provided, only a slight amount of toner can be reserved, the toner is carried inward bit by bit together with the toner which is directed inward at the above-described abutting portion of the scrapers 22*a* and 22*b* against the developing roller 10*c*. Also, even if the toner comes off or floats from the surface of the developing roller 10*c* and floats off at the abutting portion of the scrapers 22*a* and 22*b* against the developing roller 10*c*, the toner is dammed by damming surfaces of the damming members 23*a* and 23*b*. The damming surfaces of the damming members 23*a* and 23*b* are provided so as to intersect with a direction along which the scrapers 22*a* and 22*b* extend in FIG. 1. Also, the damming surface includes a surface that intersects with the surface of the developing roller 10*c*.

Then, parts related to the cleaning means of the photosensitive member will be described in brief. As shown in FIG. 1, a dipping sheet llc that dips or scoops the toner scraped off by the cleaning blade 11*a* and guides it to the waste toner reservoir 11*b* is disposed on the upstream side of the cleaning blade 11*a* in the rotating direction of the photosensitive drum (in a direction indicated by an arrow b in FIG. 1). Furthermore, as shown in FIG. 2, L-shaped end portion seals 25*a* and 25*b* are disposed on both sides of the cleaning blade 11*a* so as to be overlapped with the dipping sheet 11*c*. The positions of the end portion seals 25*a* and 25*b* in the longitudinal direction are arranged in such an area that the abutting portions 24*al* and 24*bl* of the cap rollers 24*a* and 24*b* against the photosensitive drum 7 completely cover a certain area.

As described above, white banding is caused when a distance between the photosensitive drum 7 and the developing roller 10*c* rapidly changes but is not caused if a lump of toner does not exist on the photosensitive drum 7 or the cap rollers 24*a* and 24*b*. Also, there are a temporal case in which white banding is generated because a lump of toner cannot be held between the end portion seals 25*a*, 25*b* and the photosensitive drum 7 and is then leaked therefrom, and another case in which white banding is generated when the toner is fixed onto the photosensitive drum 7 and the cap rollers 24*a* and 24*b* bit by bit and grows up.

However, it could be proved through an experiment that the provision of the damming members as described above permits the amount of toner to be reduced in any one of the above cases. That experiment was made under the following conditions. The diameter of the developing roller is ø16 mm, a gap between the developing roller and the magnetic sealing member is about 0.4 mm, a magnetic force of the magnetic sealing member is about 2000 G (gauss) on the surface, a width of the magnetic sealing member is about 4 mm, a thickness of the flexible portion of the scrapers (scraping portions) is about 0.25 mm, a width thereof is about 4.5 mm, a height and a depth of the damming member are about 3 mm, respectively, a width thereof is about 5 mm, a width of the abutting portion of the cap rollers is about 5 mm, and a width of the end portion seal is about 9 mm. In this specification, "width" means the dimension of the developing roller in the longitudinal direction. Since the thickness (depth) of the damming members is larger than the thickness of the scrapers in the rotating direction of the developing roller as shown in FIG. 1, a capacity of damming the toner by the damming members can be satisfactorily obtained. Also, since the maximum (longest) distance between the developing roller and the damming surfaces of the damming members is larger than the gap between the developing roller and the magnetic sealing members, the toner leaked on the downstream side from the magnetic sealing members in the rotating direction of the developing roller can be satisfactorily dammed by the damming members.

As described above, the amount of toner leaked from the scraping portions can be reduced by the provision of the above damming members, thereby being capable of preventing from an occurrence of white banding, or delaying it for a long period of time.

Although this embodiment is made such that the magnet MG inside of the developing roller 10*c* is stationary and the developing roller 10*c* rotates, the present invention is not limited by or to this, and a design may be made so that the developing roller 10*c* is stationary and the magnet Mg rotates.

Also, although the damming members 23*a* and 23*b* are made of polyurethane foam in this embodiment, the present invention is not limited by or to this, and for example, white banding can be prevented similarly if an elastic member having a low spring constant is employed instead.

Further, although a manner in which the damming members 23*a* and 23*b* are fitted to the scrapers 22*a* and 22*b* that function as the scraping members is applied in this embodiment, the present invention is not limited by or to this. For example, the damming members 23*a* and 23*b* may be fitted to the magnetic sealing member, or a wall of the developing container or the developing blade if such a structure is permitted.

(Other Embodiments)

Figure 5A:
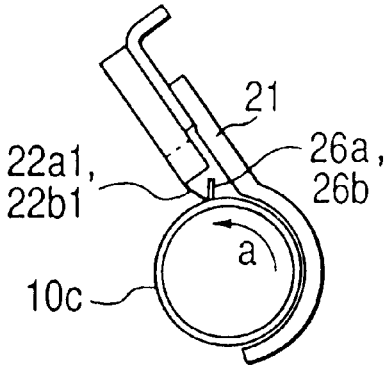
FIGS. 5A and 5B are a main cross-sectional view showing a developing apparatus in accordance with a second embodiment of the present invention and a view showing a position of the damming member on the scraping member, respectively.
Figure 5B:
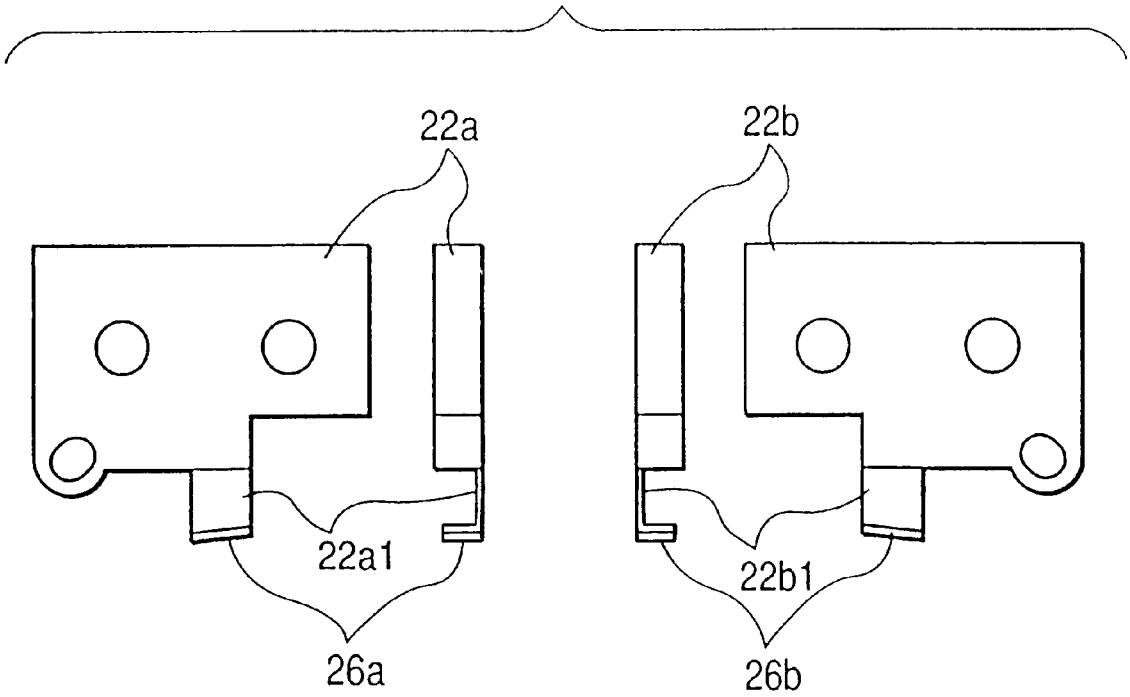
Figure 6A:
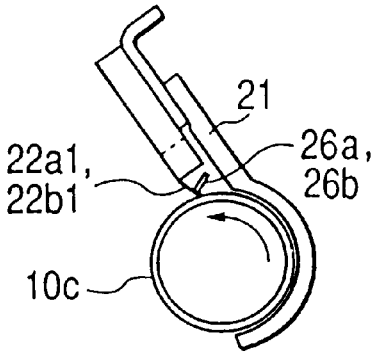
FIGS. 6A and 6B are a main cross-sectional view showing a developing apparatus in accordance with a third embodiment of the present invention and a view showing a position of the damming member on the scraping member, respectively.
Figure 6B:
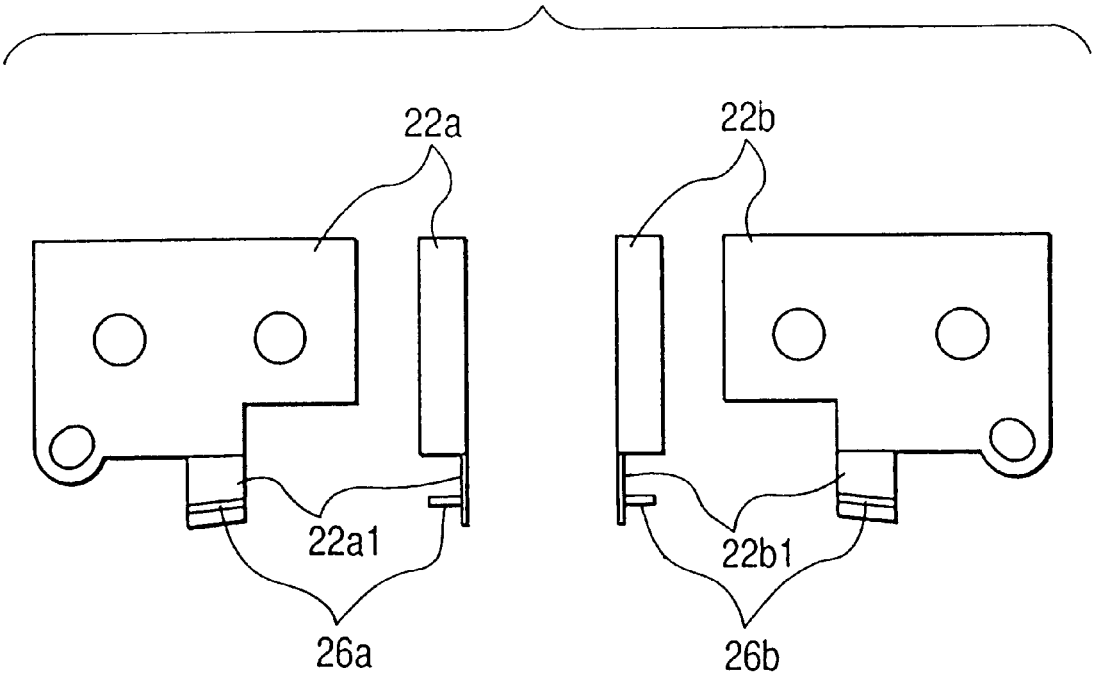
Figure 7A:
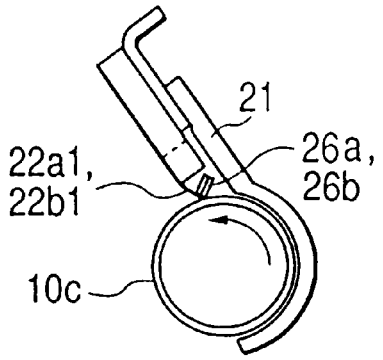
FIGS. 7A and 7B are a main cross-sectional view showing the developing apparatus in accordance with a fourth embodiment of the present invention and a view showing a position of the damming member on the scraping member, respectively.
Figure 7B:
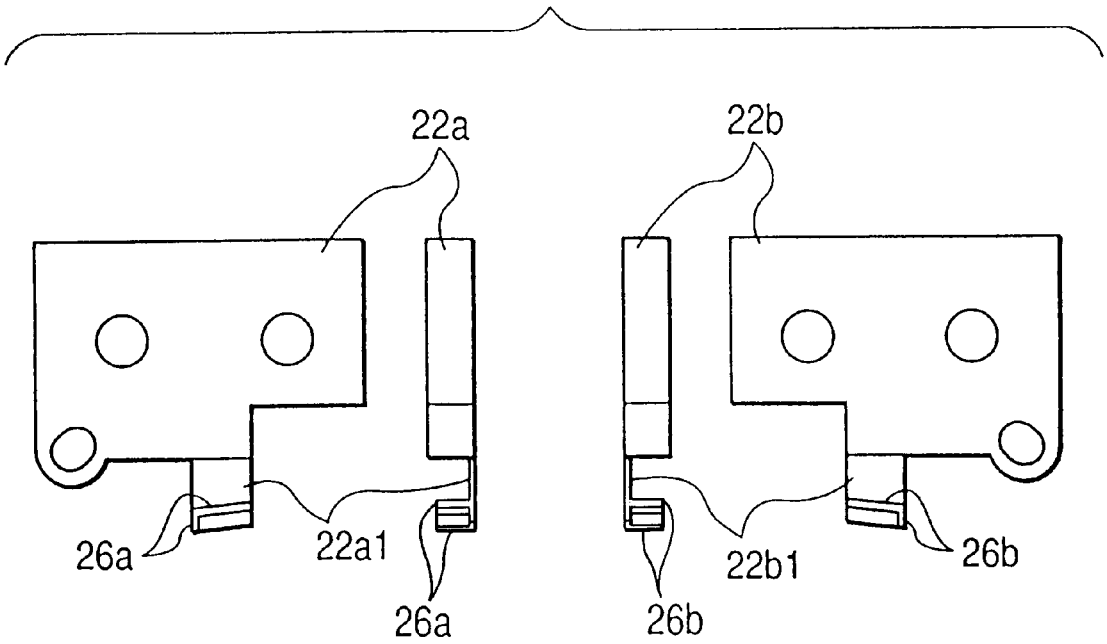

Other embodiments of the present invention will be described with reference to FIGS. 5A and 5B to 7A and 7B. FIGS. 5A, 6A and 7A are cross-sectional views showing a main portion of the developing means, and FIGS. 5B, 6B and 7B are diagrams showing a positional relationship between the scraper and the damming portion. In all of three embodiments shown in the respective drawings, walls that function as the damming portion are molded integrally with portions of the scrapers actually related to scraping. (scraping portions).

A second embodiment shown in FIGS. 5A and 5B is that walls 26*a* and 26*b* are disposed as the damming portions at leading edges of the scraping portions 22*al* and 22*bl* of the respective scrapers 22*a* and 22*b*. A third embodiment shown in FIGS. 6A and 6B is that walls 26*a* and 26*b* are disposed at positions somewhat apart from the leading edges of the scraping portions 22*al* an 22*bl* of the respective scrapers 22*a* an 22*b*. A fourth embodiment shown in FIGS. 7A and 7B is that walls 26*a* and 26*b* are disposed at two parts, that is, at positions somewhat apart from the leading edges of the scraping portions 22*al* and 22*bl* of the respective scrapers 22*a* and 22*b* and at end portions of the outside continuous to those positions. As shown in FIGS. 5B, 6B and 7B, all of the walls 26*a* and 26*b* other than those disposed at the end portions of the outside are inclined in the longitudinal direction similarly to the abutting portion of the scrapers 22*a* and 22*b* against the developing roller 10*c*. The toner pushed from the lower due to the rotation of the developing roller 10*c* is abutted against the walls 26*a* and 26*b* so as to be directed toward the inside (image region side) in the longitudinal direction. As shown in FIGS. 5A, 6A and 7A, the scraping portions are abutted against the developing roller so as to be in a counter direction with respect to the rotating direction of the developing roller.

Likewise, in those embodiments, it could be confirmed through an experiment that the toner which is stuck onto the end portion seals 25*a*, 25*b*, the photosensitive drum 7 or onto the cap rollers 24*a*, 24*b* is reduced resulting in an effect to white banding. The experiment was made under the conditions where a thickness of the walls 26*a* and 26*b* which function as the damming portions is about 0.25 mm, a height thereof is slightly less than 3 mm, and a width of the flexible portions (scraping portions) of the scrapers is about 4.5 to 7.5 mm, and other conditions are identical with those in the above-described first embodiment.

Accordingly, even with the above structure, even if the toner scraped off by the scraping portions floats off from the developing roller, the toner is dammed by the damming surfaces of the walls of the damming portions, as the result of which the amount of toner leaked outward from the scraper portions can be reduced, and the occurrence of white banding can be prevented or delayed for a long period of time.

In the above-described embodiments, the damming members are integrated with the scraping members (scrapers), but the present invention is not limited by or to this. For example, a ferromagnetic projection may be provided toward the scraping member from a portion of the magnetic sealing member which is not arc-shaped and employed as the damming member. In this case, a distance between the scraping member and the damming member may be longer.

Also, in the above-described embodiments, a description was given of a case in which the present invention is applied to the developing apparatus as process means which takes action on the electophotographic photosensitive member in the process cartridge detachably attachable to the image forming apparatus. However, the present invention is not limited by or to this. For example, the same effect is obtained even if the present invention is applied to the developing apparatus (developing cartridge) detachably attachable to the image forming apparatus, or the developing apparatus installed integrally with the image forming apparatus.

Further, the present invention is not limited by or to the developing apparatus in the abovedescribed monochrome color image forming apparatus, but the same effect may be obtained even if the present invention is applied to the developing apparatus in a full-color image forming apparatus.

While the invention has been described with reference to the structures disclosed herein, it is not confined to the details set forth and this application is intended to cover such modifications or changes as may come within the purpose of the improvements or the scope of the following claims.

What is claimed is:

1. A developing apparatus, comprising:

a developer bearing member for bearing and carrying a developer to a developing position;

a sealing member disposed in the vicinity of an end portion of said developer bearing member in a longitudinal direction of said developer bearing member and adapted for preventing the developer from being leaked from the end portion of said developer bearing member;

a developer regulating member for regulating a thickness of the developer born on said developer bearing member;

a developer scraping member for scraping the developer off from said developer bearing member by contacting with the end portion of said developer bearing member, wherein said developer scraping member has a developer scraping portion disposed on a downstream side of said sealing member and on an upstream side of the developing position in a carrying direction of the developer by said developer bearing member and said developer scraping portion is disposed so as to be overlapped with said sealing member in the longitudinal direction; and a damming portion disposed on the downstream side of said sealing member and on an upstream side of said developer scraping portion in the carrying direction, and adapted for damming the developer scraped off by said developer scraping portion, said damming portion being provided so as to be overlapped with said developer scraping portion in the longitudinal direction.

2. A developing apparatus according to claim 1, wherein a thickness of said scraping portion is smaller than a thickness of said damming portion.

3. A developing apparatus according to claim 1, further comprising a gap regulating member disposed on end portions of said developer bearing member in the longitudinal direction thereof so as to be abutted against an image bearing member for regulating a gap between a surface of said developer bearing member and a surface of said image bearing member at the developing position, said gap regulating member being provided outside of said damming portion in the longitudinal direction.

4. A developing apparatus according to claim 3, wherein said developing apparatus constitutes a process cartridge detachably attachable to a main body of an image forming apparatus together with said image bearing member.

5. A developing apparatus according to claim 1, wherein said damming portion includes a surface intersecting with a surface of said developer bearing member.

6. A developing apparatus according to claim 1, wherein said sealing member includes a magnetic member opposed to the end portion of said developer bearing member in the longitudinal direction with a gap therebetween.

7. A developing apparatus according to claim 6, wherein maximum distance between said developer bearing member and said damming portion is larger than the gap between said developer bearing member and said magnetic member.

8. A developing apparatus according to claim 1, wherein said damming portion includes an elastic foam.

9. A developing apparatus according to claim 8, wherein said elastic foam is supported by said developer scraping portion.

10. A developing apparatus according to claim 1, wherein said damming portion is molded integrally with said developer scraping portion.

11. A developing apparatus according to claim 1, wherein said damming portion includes a wall extending from a portion of said developer scraping portion which is in contact with said developer bearing member.

12. A developing apparatus according to claim 1, wherein a contact portion of said developer scraping portion contacting with said developer bearing member is inclined in the longitudinal direction so that the more said contact portion is directed toward an inside in the longitudinal direction, the more toward a downstream side in the carrying direction said contact portion is directed.

13. A developing apparatus according to any one of claims 1, 2, 5 to 12, wherein said developing apparatus constitutes a process cartridge detachably attachable to a main body of an image forming apparatus together with an image bearing member.

14. A developing apparatus according to claim 13, wherein said image bearing member comprises an electrophotographic photosensitive member.

15. A developing apparatus according to claim 1, wherein a damming surface of said damming portion is provided so as to intersect with said developer scraping portion.

16. A developing apparatus according to claim 1, wherein said damming portion is provided away from said developer bearing member.

17. A developing apparatus, comprising:

a developer bearing member for bearing and carrying a developer to a developing position;

a sealing member disposed in the vicinity of an end portion of said developer bearing member in a longitudinal direction of said developer bearing member and adapted for preventing the developer from being leaked from the end portion of said developer bearing member;

a developer scraping portion disposed on a downstream side of said sealing member and on an upstream side of the developing position in a carrying direction of the developer by said developer bearing member, and disposed so as to be overlapped with said sealing member, and adapted for scraping the developer off from said developer bearing member by contacting with said developer bearing member; and a damming portion disposed on the downstream side of said sealing member and on an upstream side of said developer scraping portion in the carrying direction, and adapted for damming the developer scraped off by said developer scraping portion, a damming surface of said damming portion being provided so as to intersect with said developer scraping portion, wherein a thickness of said scraping portion is smaller than a thickness of said damming portion in the carrying direction.

18. A developing apparatus according to claim 17, wherein said developing apparatus constitutes a process cartridge detachably attachable to a main body of an image forming apparatus together with an image bearing member.

19. A developing apparatus, comprising:

a developer bearing member for bearing and carrying a developer to a developing position;

a sealing member disposed in the vicinity of an end portion of said developer bearing member in a longitudinal direction of said developer bearing member and adapted for preventing the developer from being leaked from the end portion of said developer bearing member;

a developer scraping portion disposed on a downstream side of said sealing member and on an upstream side of the developing position in a carrying direction of the developer by said developer bearing member, and disposed so as to be overlapped with said sealing member, and adapted for scraping the developer off from said developer bearing member by contacting with said developer bearing member; and a damming portion disposed on the downstream side of said sealing member and on an upstream side of said developer scraping portion in the carrying direction, and adapted for damming the developer scraped off by said developer scraping portion, a damming surface of said damming portion being provided so as to intersect with said developer scraping portion, wherein said damming portion includes an elastic foam.

20. A developing apparatus according to claim 19, wherein said developing apparatus constitutes a process cartridge detachably attachable to a main body of an image forming apparatus together with an image bearing member.

* * * * *

UNITED STATES PATENT AND TRADEMARK OFFICE

CERTIFICATE OF CORRECTION

PATENT NO. : 6,205,304 B1
DATED : March 20, 2001
INVENTOR(S) : Hideshi Kawaguchi It is certified that error appears in the above-identified patent and that said Letters Patent is hereby corrected as shown below:

Column 4,
Line 67, "21b" should read -- 21b, --.

Column 7,
Line 31, "scraping." should read -- scraping --;
Line 39, "an" should read -- and --; and
Line 40, "an" should read -- and --.

Column 8,
Line 29, "abovedescribed" should read -- above-described --; and
Line 36, "and this" should read -- in this -- and "is" should read -- and is --.

Signed and Sealed this

Twenty-ninth Day of January, 2002

*Attest:*

*Attesting Officer*

JAMES E. ROGAN
*Director of the United States Patent and Trademark Office*